US007265672B1

(12) United States Patent
Guaragna

(10) Patent No.: US 7,265,672 B1
(45) Date of Patent: Sep. 4, 2007

(54) MAGNETIC SENSOR FOR A DOUBLE-HUNG WINDOW

(76) Inventor: Lou Guaragna, 17 Harding Ter., Dedham, MA (US) 02026

( * ) Notice: Subject to any disclaimer, the term of this patent is extended or adjusted under 35 U.S.C. 154(b) by 96 days.

(21) Appl. No.: 10/959,816

(22) Filed: Oct. 7, 2004

(51) Int. Cl.
*G08B 13/08* (2006.01)

(52) U.S. Cl. ..... 340/547; 116/86

(58) Field of Classification Search ..... 340/686.1, 340/541–572.9; 200/61.93; 49/13, 14; 335/205–207; 116/85, 86
See application file for complete search history.

(56) References Cited

U.S. PATENT DOCUMENTS

| | | | | |
|---|---|---|---|---|
| 700,812 | A | 5/1902 | Peyton | |
| 3,636,484 | A | 1/1972 | Lea | |
| 3,706,090 | A | 12/1972 | Callaghan | |
| 3,986,183 | A | 10/1976 | Fujiwara | |
| 4,209,777 | A | 6/1980 | Morrison | |
| 4,271,338 | A | 6/1981 | Rakocy | |
| 4,677,424 | A | 6/1987 | Hollinger | |
| 5,007,199 | A | 4/1991 | Dunagan et al. | |
| 5,164,705 | A | 11/1992 | Dunagan et al. | |
| 5,576,678 | A | 11/1996 | Saunders | |
| 5,610,581 | A | 3/1997 | Keller | |
| 5,712,621 | A | 1/1998 | Andersen | |
| 6,388,572 | B1 * | 5/2002 | Salter | 340/546 |
| 6,737,969 | B2 | 5/2004 | Carlson et al. | |

* cited by examiner

*Primary Examiner*—Daniel Wu
*Assistant Examiner*—Jennifer A. Mehmood
(74) *Attorney, Agent, or Firm*—John P. McGonagle

(57) ABSTRACT

An apparatus and method wherein a single sensor assembly will alarm both windows of a double hung window. The single sensor assembly provides a small magnet installed in the upper window sash and a sensor block installed on the lower window sash, said sensor block having a magnet contained in an internal raceway. The single sensor assembly is used in conjunction with a standard magnetic alarm system. The upper window sash magnet repels the sensor block magnet from one end of the sensor block diagonally upward within the sensor block raceway to an opposite end.

6 Claims, 4 Drawing Sheets

MAGNETIC SENSOR FOR A DOUBLE-HUNG WINDOW

BACKGROUND OF THE INVENTION

This invention relates to sensors, and in particular, to a magnetic sensor used in conjunction with a double-hung window.

Intrusion alarms for windows are typically designed so that window movement from a closed position actuates an alarm. For double hung windows, comprised generally of an upper window and a lower window each having slidable sashes disposed in a common frame for sliding movement past each other, intrusion alarms are generally mounted for each window. The reason for this is that, if only the lower window is alarmed, the unalarmed upper window may be forced downwardly far enough to allow entry by an intruder without tripping the lower window alarm, and vice versa. Therefore, when alarming a double hung window, two sets of sensor assemblies must be mounted and installed.

SUMMARY OF THE INVENTION

The present invention provides an apparatus and method wherein a single sensor assembly will alarm both windows of a double hung window. The single sensor assembly provides a small magnet installed in the upper window sash and a sensor block installed on the lower window sash, said sensor block having a magnet contained in an internal raceway. The single sensor assembly is used in conjunction with a standard magnetic alarm system. The upper window sash magnet repels the sensor block magnet from one end of the sensor block diagonally upward within the sensor block raceway to an opposite end. The repelled magnet interacts with a magnetic alarm system contact mounted adjacent the double hung window and near to the sensor block opposite end. As long as the repelled magnet is at the sensor block opposite end, the alarm system is in a secured state. If either window is opened, the upper window magnet's position relative to the sensor block magnet is changed and the upper window magnet no longer repels the sensor block. The magnet then, by means of gravity, slides back down the sensor block raceway away from the sensor block opposite end. This movement of the magnet breaks the connection with the magnet alarm system, thereby activating the alarm system.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
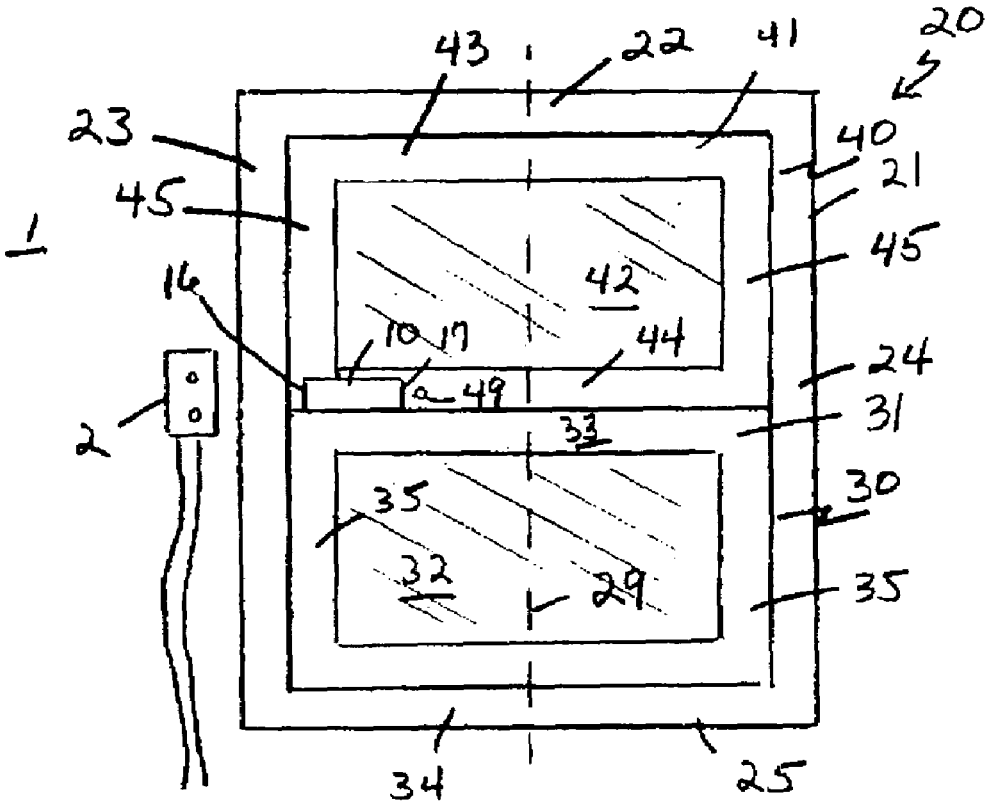
FIG. 1 is a front, plan view of a window assembly with the invention installed.

Referring to the drawings in detail wherein like elements are indicated by like numerals, there is shown a single sensor assembly 10 constructed according to the principles of the present invention and used with a double hung window assembly 20.

The illustrated window assembly 20 is a conventional, commercially available design. Although a double-hung window is disclosed here, the invention is equally applicable to other types of windows such as single-hung windows, so called "sliders," etc. The illustrated windows are of a kind sometimes thought of as "replacement" windows, but they may be used in new construction as well. The window assembly 20 is comprised, in part, of a frame 21 which maintains the remaining window components assembled as a unit and is constructed and arranged so it can be secured to a building wall 1. The frame 21 is an open rectangular structure surrounding and supporting both the lower sash 30 and the upper sash 40 for sliding movement from their closed positions along respective paths of travel generally indicated by the line 29. The frame assembly is comprised of a head 22 at the upper side of the window, jambs 23, 24 forming opposite sides of the window, respectively, and a sill 25 extending between the jambs 23, 24 to form the lower side of the window.

The lower sash 30 normally occupies the lower portion of the widow area adjacent the sill 25 and comprises a generally rectangular sash frame 31 and a glass section 32 fixed in the sash frame 31. The upper sash 40 normally occupies the upper portion of the widow area adjacent the head 22 and comprises a generally rectangular sash frame 41 and a glass section 42 fixed in the upper sash frame 41.

Figure 2:
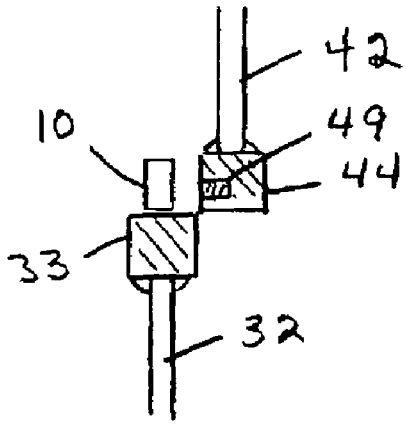
FIG. 2 is a cross-sectional schematic illustration of a double hung window sash to which the invention has been applied.
Figure 3:
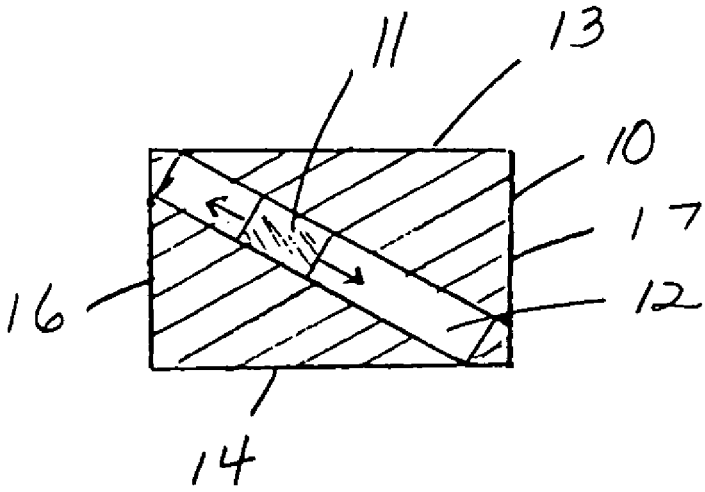
FIG. 3 is a cross-sectional side view of the sensor block.
Figure 4:
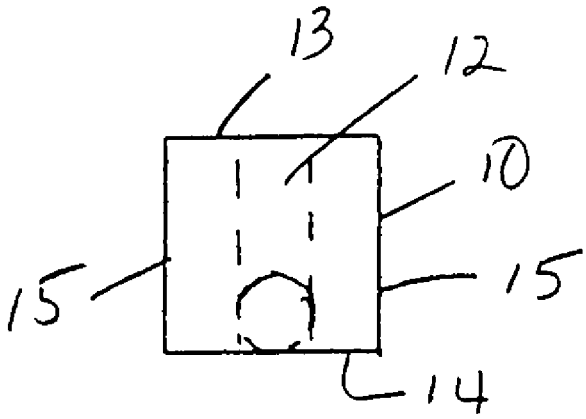
FIG. 4 is a schematic end view of the sensor block.

The lower sash frame 31 has a horizontal upper portion 33, horizontal lower portion 34 and two, opposite, vertical, side portions 35. The upper sash frame 41 has a horizontal upper portion 43, horizontal lower portion 44 and two, opposite, vertical, side portions 45. When the window 20 is closed, the lower sash frame horizontal upper portion 33 is positioned adjacent the upper sash frame horizontal lower portion 44. A small magnet 49 is installed in the upper sash. The small magnet 49 may be installed in the upper sash horizontal lower portion 43 (FIGS. 1 and 2) or an upper sash vertical side portion 45 (FIGS. 5 through 8).

The single sensor assembly 10 is comprised of a sensor block 10 installed on the lower sash horizontal upper portion 33 near to a frame jamb 23 adjacent the upper sash vertical portion 45 containing the small magnet 49. The sensor block 10 is a generally rectangular block having a magnet 11 contained in a internal cylindrical raceway 12. In this embodiment of the invention, the magnet 11 is cylindrical. The sensor block 10 has a top 13, bottom 14, two parallel, opposite sides 15, a first end 16 and a second end 17. The internal raceway 12 extends from the second end 17 near to the bottom 14, upward to the first end 16 near to the top 13. In some cases due to window construction it is desirable to raise the sensor block 10. This is done by adding a bridge 18 to the sensor block bottom 14. See FIGS. 7 and 8.

Figure 5:
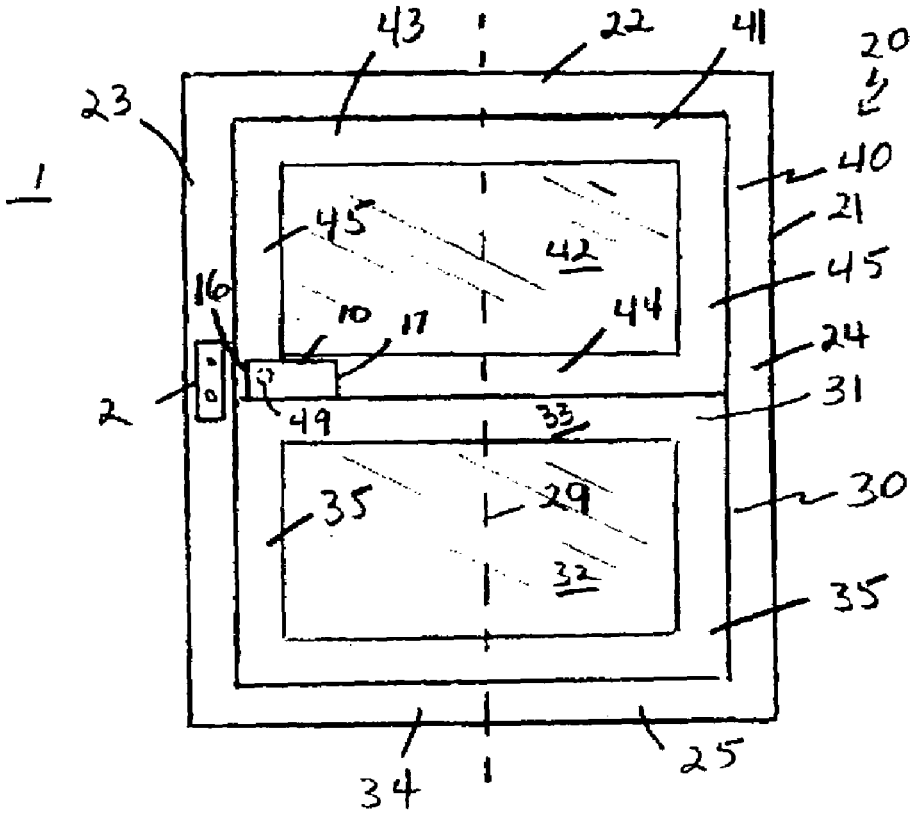
FIG. 5 is a front, plan view of a window assembly with an alternate embodiment of the invention installed.
Figure 6:
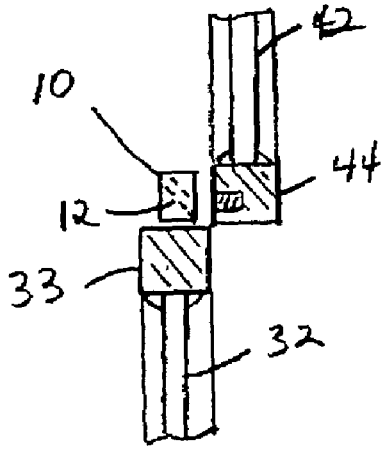
FIG. 6 is a cross-sectional schematic illustration of the invention embodiment of FIG. 5.
Figure 7:
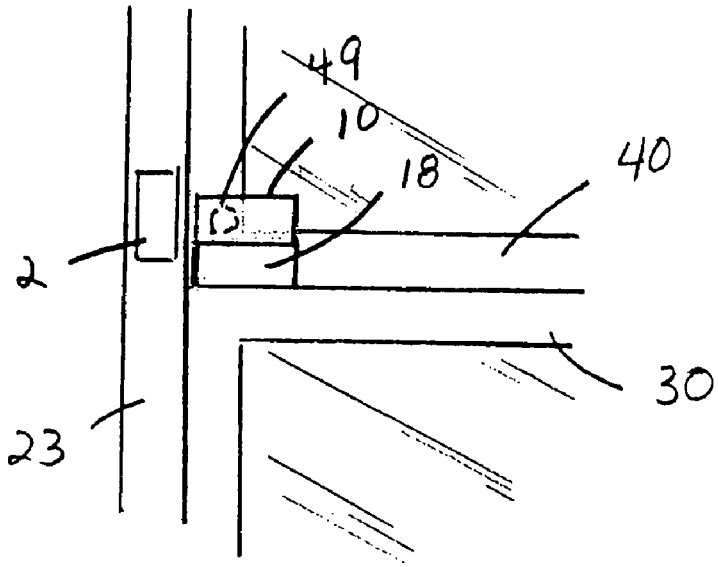
FIG. 7 is a sectional view of a window assembly with the invention installed with a bridge.
Figure 8:
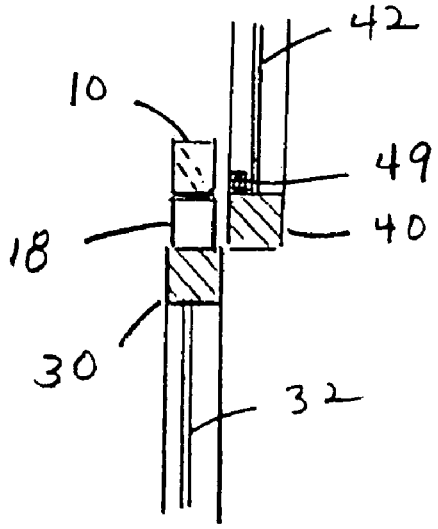
FIG. 8 is a cross-sectional schematic illustration of the invention embodiment of FIG. 7

The sensor block 10 is used in conjunction with a standard magnetic alarm system 2 attached to the building wall 1 adjacent a window assembly frame jamb 23 (FIG. 1) or to a window jamb 24 (FIG. 5). The upper window sash magnet 49 repels the sensor block cylindrical magnet 11 from the sensor block second end 17 diagonally upward within the sensor block raceway 12 to the sensor block first end 16. The repelled cylindrical magnet 11 interacts with the magnetic alarm system 2. As long as the repelled cylindrical magnet 11 is at the sensor block first side 16, a magnetic connection is made with an alarm contact thereby normalizing an alarm loop. If either window sash 30, 40 is moved, the position of the upper sash magnet 49 relative to the sensor block cylindrical magnet 11 is changed. The upper sash magnet 49 will no longer repel the sensor block cylindrical magnet 11. The sensor block magnet 11 then, by means of gravity, will slide back down the sensor block raceway 12 from the sensor block first side 16 to the sensor block second side 17. The movement of the block magnet 11 away from the magnetic alarm system 2 breaks a connection with the magnet alarm loop, thereby activating the alarm system 2.

It is understood that the above-described embodiment is merely illustrative of the application. Other embodiments may be readily devised by those skilled in the art which will embody the principles of the invention and fall within the spirit and scope thereof. Instead of a simple gravity system as described above, wherein a sensor block 10 with a hollow raceway 12 tilted at an approximate 45 degree angle is provided, the raceway 12 may contain a magnet 11 with a spring (not shown) or elastomeric material (not shown). Applicant has found that a spring or elastomeric material provides a level of complexity which may effect long term sensor reliability. The latter two embodiments are also more expensive and require a carefully calibrated magnet. The preferred embodiment described in detail above depends only on magnet repelling forces and gravity.

I claim:

1. A single magnetic sensor assembly in combination with a double hung window assembly comprised of a frame secured to a building wall, said frame having an open rectangular structure surrounding and supporting both a lower sash and an upper sash adapted for sliding movement from closed positions along respective vertical paths of travel, said frame having a head at an upper side of the window assembly, two jambs forming opposite sides of the window assembly, and a sill extending between the jambs to form a lower side of the window, said lower sash occupying a lower portion of the window area adjacent the sill and comprising a generally rectangular sash frame and a glass section fixed in the sash frame, said upper sash occupying an upper portion of the widow area adjacent the head and comprising a generally rectangular sash frame and a glass section fixed in the upper sash frame, said lower sash frame having a horizontal upper portion, a horizontal lower portion and two, opposite, vertical, side portions, said upper sash frame having a horizontal upper portion, a horizontal lower portion and two, opposite, vertical, side portions, said window assembly being closed when the lower sash frame horizontal upper portion is positioned adjacent the upper sash frame horizontal lower portion, comprising:

a small magnet inserted into the upper sash;

a sensor block installed on the lower sash horizontal upper portion, said sensor block having an internal raceway with a magnet slidably contained within;

a magnetic alarm system adjacent said double hung window.

2. A single magnetic sensor assembly as recited in claim 1, wherein:

said small magnet is inserted in a said upper sash vertical side portion.

3. A single magnetic sensor assembly as recited in claim 2, wherein:

said sensor block is installed on the lower sash horizontal upper portion near to a frame jamb adjacent the upper sash vertical side portion nearest the small magnet.

4. A single magnetic sensor assembly as recited in claim 3, wherein:

the sensor block is a generally rectangular block having a top, bottom, two parallel, opposite sides, a first end and a second end, said internal raceway extending from the second end near to the bottom, upward to the first end near to the top.

5. A single magnetic sensor assembly as recited in claim 4, wherein:

said small magnet is adapted to repelling the sensor block cylindrical magnet away from the sensor block second end diagonally upward within the sensor block raceway to the sensor block first end;

wherein said repelled sensor block cylindrical magnet is adapted to disable the magnetic alarm system, said cylindrical magnet adapted to sliding by means of gravity down the sensor block raceway away from the sensor block first side to the sensor block second side if either the upper sash or lower sash is vertically moved thereby changing the position of the small magnet relative to the sensor block cylindrical magnet, said movement of the cylindrical magnet away from the magnetic alarm system thereby breaking the disabling connection with the magnet alarm system, thereby activating the alarm system.

6. A single magnetic sensor assembly as recited in claim 5, further comprising:

a bridge attached to said sensor block bottom.

* * * * *